United States Patent [19]

Cannon

[11] 4,089,046

[45] May 9, 1978

[54] MUSIC STAND LAMP

[76] Inventor: William P. Cannon, c/o Cannon Products, Inc., Box 422, Elwood, Ind. 46036

[21] Appl. No.: 797,195

[22] Filed: May 16, 1977

[51] Int. Cl.[2] ..... F21V 33/00

[52] U.S. Cl. ..... 362/99; 362/127

[58] Field of Search ..... 240/2 P; 362/99, 127

[56] References Cited

U.S. PATENT DOCUMENTS 2,273,361 2/1942 Kozloff ..... 240/2 P

*Primary Examiner*—Stephen J. Lechert, Jr.

*Attorney, Agent, or Firm*—Jenkins, Coffey & Hyland

[57] ABSTRACT

A lamp for mounting on a music stand having a lower ledge with an upstanding support plate. The lamp has a horizontally elongated base connected to an upwardly extending front upright, having a lamp assembly mounted at its upper end. A downwardly extending rear upright is connected to and spaced rearwardly from the upper end of the front upright by an adjustable connector. The front and rear uprights together form a vertically elongated and downwardly open slot for receiving the support plate of a music stand with the base resting on the lower ledge of the stand. The connector is adjustable to vary the spacing between the front and rear uprights to bring said uprights into abutting engagement with the front and rear sides of the support plate.

13 Claims, 8 Drawing Figures

MUSIC STAND LAMP

BACKGROUND OF THE INVENTION

This invention relates to a lamp for use with a music stand. More specifically, this invention relates to a lamp for quick and easy mounting in a stable position on any of a wide variety of music stands having different shapes and sizes.

Music stands and the like are widely used for supporting sheet music during a live musical performance. Music stands are available as separate portable items having height-adjustable frame carrying a lower ledge with an upstanding support plate. Alternately, music stands are constructed as part of the musical instrument, such as on a piano or an organ. On pianos and organs, the support plate is typically mounted directly on the instrument, behind and above the keyboard, and the lower ledge for supporting sheet music is provided by the piano or organ housing immediately in front of the support plate. In either event, music stands are manufactured from a wide variety of materials and have a wide variety of decorative sizes and shapes. Moreover, the support plate is often hingedly or pivotally connected with respect to the lower ledge to allow the music stand to be moved to a compact position, or to allow tilt adjustment of the support plate.

It is often desirable to provide a lamp for illuminating sheet music supported on a music stand. To this end, many different music stand lamps have been proposed throughout the prior art. Some of these lamps comprise a separate adjustable stand for supporting a lamp in a position for directing light onto a music stand. See, for example, U.S. Pat. Nos. 1,113,771 and 2,662,164. However, these lamp constructions are relatively large and bulky, and occupy substantial space in the vicinity of the music stand and the performer. Moreover, such lamps are difficult to adjust for proper illumination of the music stand without interfering with the performer.

Some prior art music stand lamps have been proposed which are mounted directly on the support plate of a music stand. Of these lamps, some include clamps for rigidly attaching to the top of the support plate. See, for example, U.S. Pat. No. 1,847,051. Other lamps have springably biased clips for snug reception of the top of the music stand support plate. See, for example, U.S. Pat. Nos. 1,949,289 and 3,127,114. All of these lamp constructions are advantageous in that they are relatively compact in size, and provide a source of illumination positioned immediately adjacent to sheet music on the music stand. However, all of these lamp constructions attach to the top or rear of the music stand and include an upper, forwardly extending lamp assembly to provide a relatively top-heavy or unstable construction. Accordingly, the lamp tends to be mounted on the music stand in a relatively unstable position. This is particularly true when the support plate of the music stand is hinged to tilt forwardly with respect to the lower ledge, since the forwardly extending lamp assembly tends to encourage such tilting. Moreover, such prior art lamp constructions generally are not well suited for use with an infinite number of different sizes and shapes of music stands, particularly with ornately shaped music stands of the type found on modern pianos and organs.

The music stand lamp of this invention overcomes the problems and disadvantages of the prior art by providing a music stand lamp which is quickly and easily adjusted in a stable position on music stands having any of a substantially infinite number of sizes and shapes.

SUMMARY OF THE INVENTION

In accordance with the invention, a music stand lamp has a horizontally elongated base connected to an upstanding front upright. A lamp assembly extends forwardly from the upper end of the front upright, and includes an illumination source carried in a reflector for directing light downwardly. A rear upright is connected to the upper end of the front upright by an adjustable connector, and extends downwardly from the connector behind the front upright. The adjustable connector spaces the rear upright rearwardly away from the front upright, and is adjustable for varying the spacing between the front and rear uprights.

The front and rear uprights together provide a vertically elongated, downwardly open slot for receiving the support plate of a music stand, regardless of the specific size or decorative shape of the support plate. The music stand support plate is receivable between the front and rear uprights with the lamp base resting upon the lower supporting ledge of the music stand. The adjustable connector is adjusted to bring the front and rear uprights into snug abutting engagement with a substantial portion of the height of the support plate to securely lock the lamp in a stable, low center of gravity position on the music stand.

BRIEF DESCRIPTION OF THE DRAWINGS

The accompanying drawings illustrate the invention. In such drawings.

DETAILED DESCRIPTION OF THE PREFERRED EMBODIMENT

Figure 1:
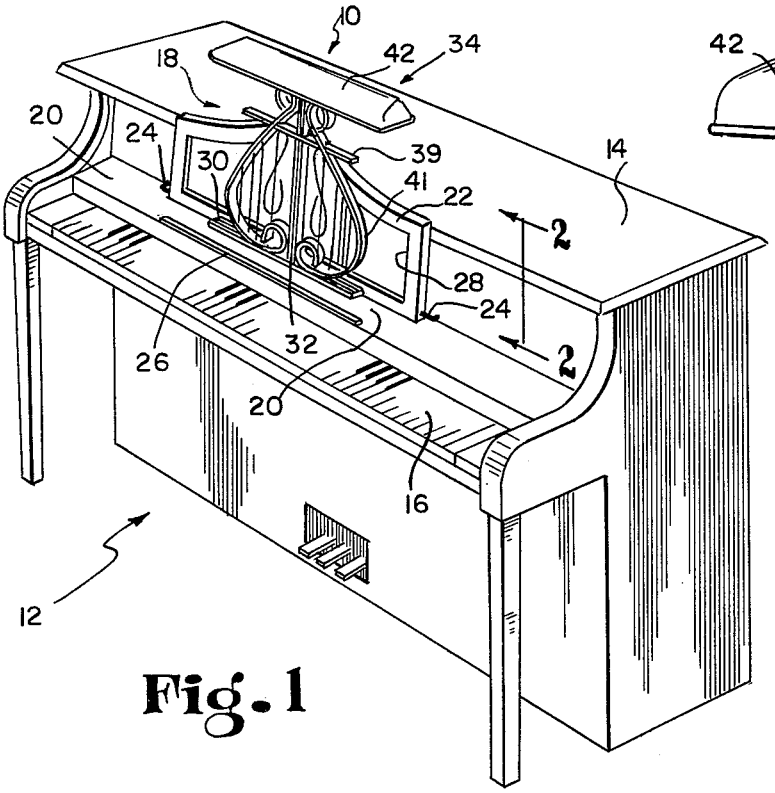
FIG. 1 is a perspective view of a music stand lamp of this invention mounted on a piano.

A music stand lamp 10 of this invention is shown in FIG. 1 mounted on an upright piano 12. As shown, the piano 12 comprises an instrument housing 14 typically formed from wood or the like and carrying a keyboard 16. A music stand 18 is constructed directly on the piano 12 above and behind the keyboard 16. More specifically, the instrument housing 14 is formed to have a flat, horizontally extending ledge surface 20 above and behind the keyboard 16. A music stand support plate 22 is connected near the rear of the ledge 20 by horizontally oriented hinges 24, and extends upwardly from the hinges 24 to provide a backing surface for supporting sheet music or the like. Thus, the ledge 20 and the support plate 22 combine to form the music stand 18. Conveniently, a raised strip 26 is mounted on the ledge 20 spaced to the front of the support plate 24 to prevent sheet music from sliding off the music stand.

As shown in FIG. 1, the support plate 22 is formed from a series of interconnected strips of wood or the like. The support plate 22 is decoratively shaped to provide a pleasing ornamental appearance. In this regard, the support plate 22 includes openings 28 to provide an open lacework appearance, as well as a discontinuously shaped upper surface. The support plate 22 is movable about the horizontal axis of the hinges 24, and normally tilts slightly rearwardly to a rest position spaced slightly in front of the upright portion of the piano housing 14 to provide a conveniently positioned backing surface for supporting sheet music.

Figure 2:
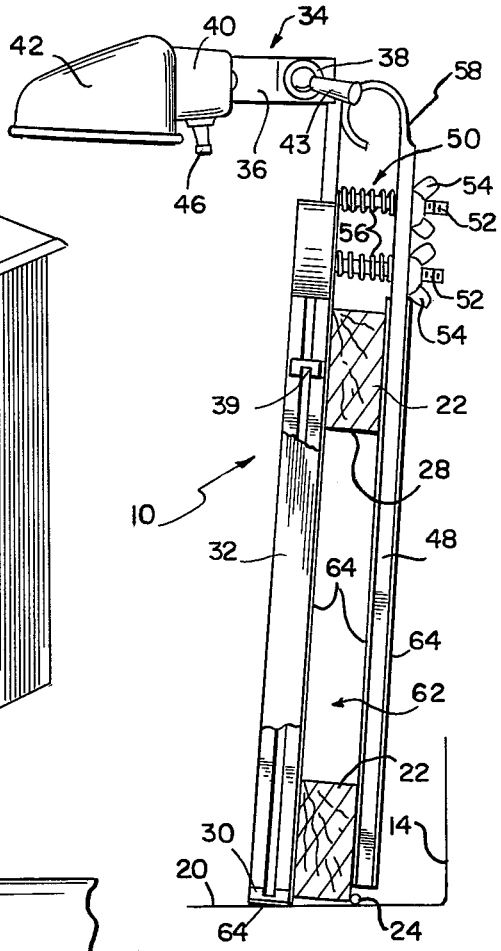
FIG. 2 is an enlarged end view taken on the line 2—2 of FIG. 1, with portions broken away.
Figure 3:
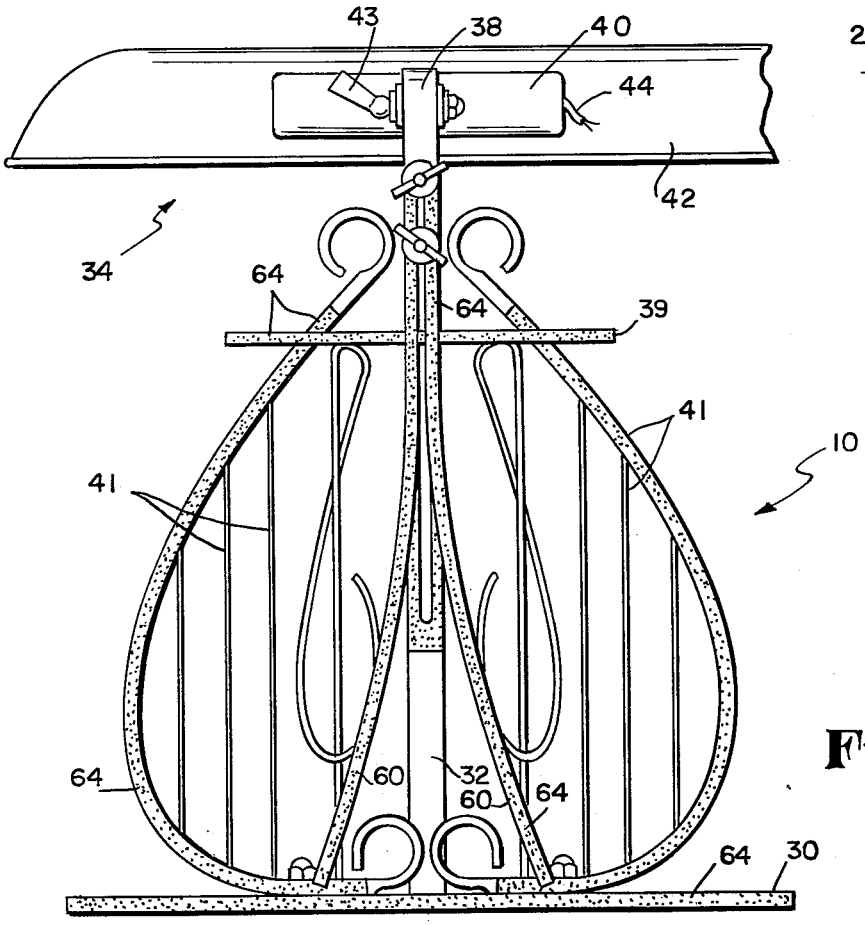
FIG. 3 is an enlarged rear view of the lamp.

The music stand lamp 10 of this invention is adapted to mount directly on the music stand 18 in a stable position. The music stand lamp 10 is formed from metal strips or the like, and as shown in FIGS. 1–3, comprises a horizontally elongated base 30 resting on the ledge 20 of the music stand. A front upright 32 is connected to the center of the base 30, as by welding, and extends vertically upwardly from the base. Importantly, the front upright 32 has a height greater than the height of the music stand support plate 22, and is connected at its upper end to a lamp assembly 34. Conveniently, the front upright 32 is also connected near its upper end to a transverse member 39 which, along with the front upright 32 and the base 30, is connected to and supports decorative metalwork such as the lyre designwork 41 shown in the drawings.

The lamp assembly 34 comprises an arm 36 connected to the upper end of the front upright 32 by a pivotal clamp connector 38. The arm 36 extends generally forwardly from the front upright 32, and is angularly adjustable with respect to the front upright by a lever 43 on the clamp connector 38. The arm 36 is connected at its forward end to a switch housing 40. The switch housing 40 carries a downwardly open reflector shade 42 in which is mounted one or more sources of illumination such as incandescent or fluorescent bulbs (not shown). Electrical power for the bulbs is provided via a power cord 44 connected to the switch housing 40, and controlled by an on-off switch 46. With this construction, the lamp assembly provides illumination for direction downwardly onto sheet music supported in front of the lamp 10 on the music stand 18.

As shown in FIGS. 2 and 3, a rear upright 48 is connected near its upper end to the front upright 32 near the upper end of said front upright by a pair of adjustable connectors 50. More specifically, the connectors comprise a pair of vertically spaced screws 52 each received rearwardly through aligned openings formed in the front and rear uprights 32 and 48. Wing nuts 54 are received over the ends of the screws 52 behind the rear uprights 48 to connect the front and rear uprights together. Compression springs 56 are received over the screws 52 between the front and rear uprights 32 and 48 to space the uprights away from each other. Conveniently, the upper end 58 of the rear upright 48 is rolled forwardly to provide a minimum spacing between the upper ends of said uprights. The rear upright 48 extends downwardly from the spring-loaded connectors 50, and splits apart near its lower end to form a spreading, Y-shaped configuration 60. The rear upright 48 terminates at its lower end slightly above the lamp base 30, and thereby combines with the front upright 32 to form a vertically elongated, downwardly open slot 62.

In use, as shown in FIGS. 1 and 2, the music stand lamp 10 of this invention is mounted on a music stand 18 with the support plate 22 received within the slot 62. That is, the front and rear uprights 32 and 48 straddle the support plate 22, with the designwork 41 and the Y-shaped rear upright configuration 60 providing a wide area of engagement with the plate 22. The front and rear uprights 32 and 48, and the slot 62, are sized and shaped such that the lamp base 30 rests flat on the music stand ledge 20, and the two spring-loaded connectors 50 are disposed above the uppermost surface of the support plate 22. The spring-loaded connectors 50 are adjustable by means of the wing nuts 54 to bring the front and rear uprights 32 and 48 into binding, abutting engagement with the front and rear sides of the support plate 22 over substantially the entire height of said support plate. More specifically, as the spring-loaded connectors 50 are tightened, the rear upright 48 pivots slightly above its rolled upper end 58 to bring the lower end of the rear upright into abutting engagement with the lower end of the support plate 22. Additional tightening of the connectors 50 serves to bring the rear upright into snug abutting engagement with the plate 22 over substantially the entire height of said plate. Conveniently, as shown in the drawings, felt strips 64 are appropriately provided on all surfaces of the lamp contacting the piano and the music stand to prevent marring of the furniture.

The lamp 10 of this invention mounts on the music stand 18 in a stable, low center of gravity position. That is, the major portion of the weight of the lamp 10 is carried by the lamp base 30 supported on the ledge 20 of the music stand 18. The major portion of the lamp weight is not carried by the support plate 22 to thereby avoid a high center of gravity configuration. Moreover, the lamp 10 of this invention snugly engages the support plate 22 over substantially the entire height of the support plate so that there is no danger of knocking the lamp loose from the music stand. Still further, as shown in FIG. 2, the front and rear uprights 32 and 48 serve to lock the lamp base 30 on the lower edge 20 in a horizontal plane below the lower, forwardmost edge of the tilted support plate. In this position, the lamp base 30 effectively locks the support plate 22 against forward movement about the hinges 24, and thereby rigidly secures the lamp 10 and the support plate 22 in place.

Figure 4:
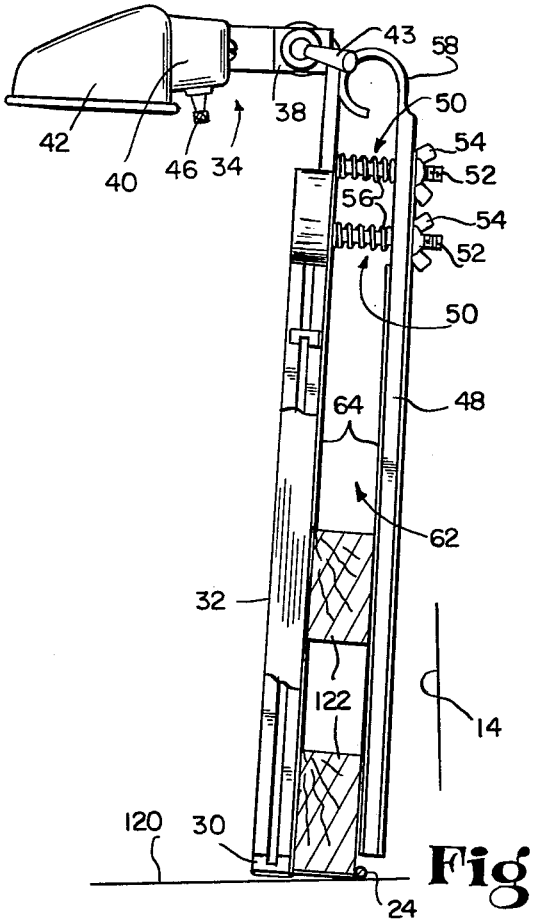
FIG. 4 is an enlarged end view similar to FIG. 2 showing the lamp mounted on a music stand of a different size and shape.

The music stand lamp of this invention is usable on an almost infinite variety of music stands having different sizes and shapes. That is, music stands are manufactured having support plates of a wide variety of sizes and shapes. The lamp 10 of this invention securely mounts on any music stand having a support plate, and particularly those wherein the support plate has a height less than the height of the slot 62 between the front and rear uprights 32 and 48. For example, as shown in FIG. 4, the front and rear uprights 32 and 48 are readily adjusted by means of the connectors 50 to snugly engage the support plate 122 of a music stand having a height different than the height of the support plate 22 shown in FIGS. 1 and 2. Again, the front and rear uprights 32 and 48 snugly engage the support plate 122 with the major portion of the lamp weight being carried by the base 30 of the lamp on a music stand lower ledge 120.

Figure 5:
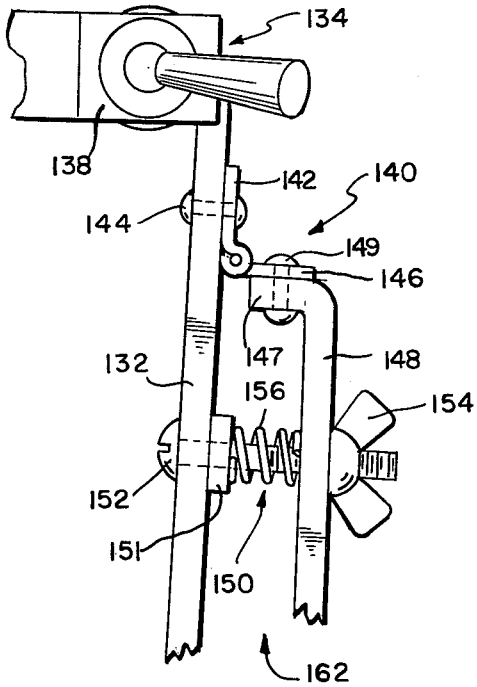
FIG. 5 is an enlarged fragmented end view of a portion of an alternate embodiment of the invention.

An alternate embodiment of the invention is shown in FIG. 5. As shown, a front upright 132 for the modified lamp has a lamp assembly 134 mounted at its upper end by a clamp connector 138. A hinge 140 has one leg 142 connected near the upper end of the front upright 132 by a rivet 144. The other leg 146 of the hinge 140 is connected to a forwardly turned tab 147 at the top of a rear upright 148 by another rivet 149. An adjustable connector 150 is connected between the front and rear uprights 132 and 148, and comprises a screw 152 received rearwardly through aligned openings in said uprights. A compression spring 156 is carried on the screw 152 between the front and rear uprights to bias the uprights away from each other, and a wing nut 154 is received over the screw 152 for use in controllably adjusting the spacing between said uprights. Conveniently, a nut 151 is received over the screw 152 and bears against the front upright 132 to lock the screw in position with respect to the front upright.

The front and rear uprights 132 and 148 together form a vertically extending gap slot 162 for receiving the support plate 22 of a music stand 18. The wing nut 154 is adjustable on the screw 152 to bring the front and rear uprights into snug abutting engagement with a support plate over a substantial portion of the support plate. As in the previous embodiment, the lamp of FIG. 5 is provided with a horizontal base (not shown) for resting on the ledge 20 of a music stand such that the base and the uprights together securely lock the lamp in place.

Figure 6:
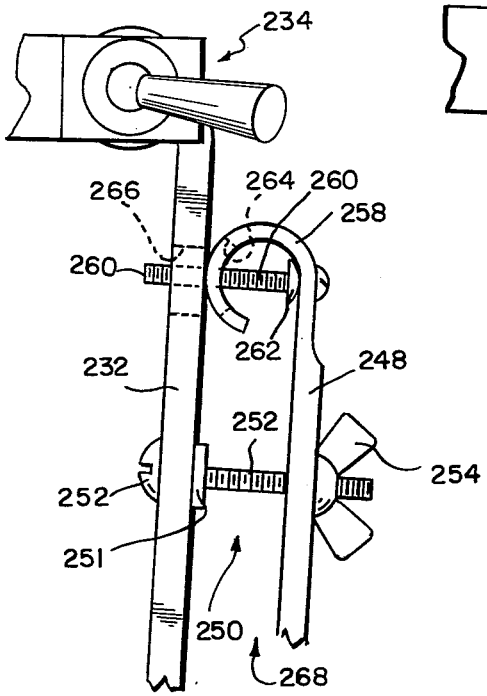
FIG. 6 is an enlarged fragmented end view of a portion of another alternate embodiment of the invention.

Another alternate embodiment of the invention is shown in FIG. 6. As shown, a front upright 232 has a lamp assembly 234 mounted at its upper end. A rear upright 248 is positioned behind the front upright 232, and is movably connected to the front upright by an adjustable connector 250. The connector 250 comprises a screw 252 received rearwardly through aligned holes in the uprights, and including a nut 251 received over the screw for locking the screw 252 with respect to the front upright 232. A wing nut 254 is received over the rear end of the screw 252 for use in controllably adjusting the spacing between the uprights.

The upper end 258 of the rear upright 248 is curled forwardly to abut the front upright 232 near the upper end of the front upright, and thereby provide a minimum spacing between the front and rear uprights. A screw 260 extends forwardly through the rear upright upper end 258, and is locked with respect thereto by a nut 262. The screw 260 extends further through aligned and vertically milled slots 264 and 266 formed respectively in the curled upper end 258 and in the front upright 232.

As in the previous embodiments, the front and rear uprights 232 and 248 combine to form a vertical slot 268 for receiving the support plate 22 of a music stand. The connector 250 is adjustable to bring the front and rear uprights 232 and 248 into binding engagement with the front and rear sides of the support plate with the lamp base (not shown) locked in position on the music stand ledge.

Figure 7:
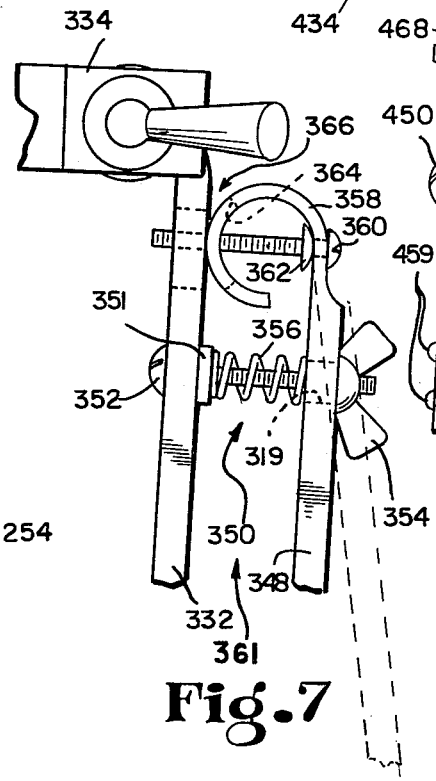
FIG. 7 is an enlarged fragmented end view of a portion of still another embodiment of the invention.

Another alternate embodiment of the lamp of this invention is shown in FIG. 7. As shown, a front upright 332 includes a lamp assembly 334 mounted at its upper end. A rear upright 348 is positioned behind the front upright 332, and is connected to the front upright by an adjustable connector 350. The connector 350 comprises a screw 352 received rearwardly through the front upright 332 and through a slightly enlarged opening 319 in the rear upright 348. A nut 351 is received over the screw to lock the screw with respect to the front upright, and a wing nut 354 is received over the screw behind the rear upright for use in controllably adjusting the spacing between said uprights. A compression spring 356 is carried on the screw 352 between the front and rear uprights, and serves to bias the rear upright 348 rearwardly away from the front upright.

The upper end 358 of the rear upright 348 is curled forwardly to abut the front upright 332 near the upper end of the front upright, and thereby provide a minimum spacing between the front and rear uprights. A screw 360 extends forwardly through the rear upright upper end 358, and is locked with respect thereto by a nut 362. The screw 360 extends further through aligned and vertically elongated milled slots 364 and 366 formed respectively in the curled upper end 358 and in the front upright 332.

In operation, the wing nut 354 on the lower screw 352 is adjusted as needed to adjust the position of the rear upright with respect to the front upright. More specifically, as the wing nut 354 is loosened, the rear upright 348 pivots generally about its curled upper end 358 away from the front upright 332 toward the dotted line position shown in FIG. 7. Conversely, when the wing nut 354 is tightened, the lower end of the rear upright 348 swings toward the front upright to decrease the width of the gap 361 between the uprights, and thereby snugly engage the support plate of a music stand. Importantly, the upper screw 360 received through the slots 364 and 366 serves to guide swinging of the rear upright in a manner to maintain the two uprights substantially in a common plane.

Figure 8:
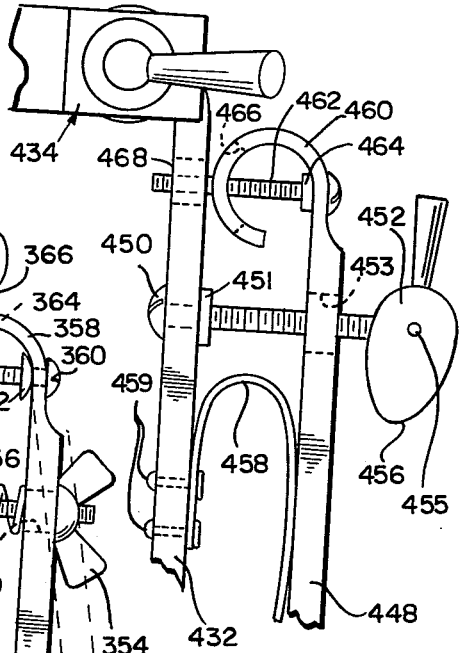
FIG. 8 is an enlarged fragmented end view of a portion of another alternate embodiment of the invention.

Still another alternate embodiment of the invention is shown in FIG. 8. As shown, a front upright 432 includes a lamp assembly 434 at its upper end. A rear upright 448 is positioned behind the front upright 432, and is connected to the front upright by a screw 450 and a cam lever 452. More specifically, the screw 450 is received rearwardly through the front upright and is locked in position with respect thereto by a nut 451. The screw 450 extends further rearwardly through a vertically elongated slot 453 formed in the rear upright 448. Behind the rear upright, the cam lever 452 is pivotally mounted on the screw 450 by a pin 455, and includes a cam surface 456 for partial reception in the slot 453 to bear against the rear upright 448, and thereby control the spacing of the rear upright from the front upright. Importantly, a spring 458 is connected to the front upright by rivets 459 and bears against the rear upright to urge the rear upright rearwardly into contact with the cam lever 452.

The upper end 460 of the rear upright 448 is curled forwardly to contact the front upright 432, and thereby provide a minimum spacing between the front and rear uprights. A screw 462 is received rearwardly through the curled upper end 460, is locked in position by a nut 464, and extends forwardly through aligned vertically elongated slots 466 and 468 formed in said curled upper end 460 and the front upright. Thus, in operation, the cam lever 452 and the spring 458 cooperate with the rear upright 448 to control the spacing between the front and rear uprights. As the spacing is adjusted, the rear upright pivots generally about its curled upper end 460, with the upper screw 462 serving to maintain the two uprights in a common plane.

The music stand lamp of this invention is usable on a wide variety of music stands having a lower ledge and an upstanding support plate, regardless of whether the music stand is constructed directly on an instrument such as a piano or is provided as a separate item. Moreover, a wide variety of lamp designs and decorative lamp shades are possible utilizing the base, front upright, and rear upright construction of this invention.

I claim:

1. A lamp for mounting on a music stand, comprising a front upright; a horizontally extending base mounted on the lower end of said front upright; a lamp assembly mounted at the upper end of said front upright; a rear upright; and means connected between said front and rear uprights near their upper ends for variably spacing said uprights from each other, said rear upright extending downwardly from said connecting means so that said front and rear uprights form a downwardly open slot for receiving a music stand.

2. A lamp as set forth in claim 1 wherein said connecting means includes biasing means for biasing said rear upright away from said front upright.

3. A lamp as set forth in claim 1 wherein said connecting means comprises a screw received through aligned holes formed in said front and rear uprights, a compression spring carried on said screw between said uprights for urging said uprights away from each other, and a nut received on said screw for adjustably varying the space between said uprights.

4. A lamp as set forth in claim 1 wherein said connecting means comprises a spring-loaded connector.

5. A lamp as set forth in claim 1 wherein said connecting means comprises a pair of vertically spaced spring-loaded connectors each connected between said front and rear uprights near their upper ends.

6. A lamp as set forth in claim 5 wherein each of said spring-loaded connectors comprises a screw received through aligned holes formed in said front and rear uprights, a compression spring carried on said screw between said uprights for urging said uprights away from each other, and a nut received on said screw for adjustably varying the spacing between said uprights.

7. A lamp as set forth in claim 1 wherein said connecting means comprises a first connector connected between said front upright and the upper end of said rear upright and including means for spacing said uprights from each other, and a second connector connected between said front and rear uprights below said first connector and including means for varying the spacing between said uprights.

8. A lamp as set forth in claim 1 including means on the upper end of said rear upright for providing a minimum spacing between said front upright and the upper end of said rear upright.

9. A lamp as set forth in claim 8 wherein said spacing means includes means for maintaining said front and rear uprights in a common plane.

10. A lamp as set forth in claim 1 for mounting on a music stand having a generally horizontal lower ledge and an upstanding support plate, wherein the slot formed by said front and rear uprights has a height greater than the height of the support plate so that the lamp is mountable on the music stand with the support plate received in said slot and said base supported on the lower ledge, said connecting means being adjustable for bringing said front and rear uprights into abutting engagement with the support plate over a substantial portion of the height thereof.

11. A lamp as set forth in claim 1 wherein said connecting means comprises spring means for biasing said rear upright away from said front upright, and cam lever means for controllably urging said rear upright forwardly against said spring means.

12. A lamp for mounting on a music stand having a generally horizontal lower ledge and an upstanding support plate, comprising a front upright having a height greater than the height of the support plate; a horizontally extending base mounted on the lower end of said front upright; a lamp assembly mounted on the upper end of said front upright; a rear upright; and means connected between said front and rear uprights near their upper ends for variably spacing said uprights from each other, said rear upright extending downwardly from said connecting means so that said front and rear uprights form a downwardly open slot for receiving the music stand support plate, said connecting means being adjustable to bring said front and rear uprights into abutting engagement with the support plate over a substantial portion of the height thereof and with said base supported on the music stand lower ledge.

13. A lamp for mounting on a music stand, comprising a front upright; a horizontally extending base mounted on the lower end of said front upright; a lamp assembly mounted at the upper end of said front upright; a rear upright; first means connected between said front and rear uprights near their upper ends for spacing said uprights from each other; and second means connected between said front and rear uprights near their upper ends and vertically spaced below said first means, said second means being adjustable for varying the spacing between said uprights, said rear upright extending downwardly from said second means so that said front and rear uprights form a downwardly open slot for receiving a music stand.

* * * * *